US009649671B2

(12) United States Patent
Virtanen

(10) Patent No.: US 9,649,671 B2
(45) Date of Patent: May 16, 2017

(54) CLEANING DEVICE

(71) Applicant: Tommi Virtanen, Kuusisto (FI)

(72) Inventor: Tommi Virtanen, Kuusisto (FI)

( * ) Notice: Subject to any disclaimer, the term of this patent is extended or adjusted under 35 U.S.C. 154(b) by 0 days.

(21) Appl. No.: 14/600,059

(22) Filed: Jan. 20, 2015

(65) Prior Publication Data

US 2016/0121377 A1 May 5, 2016

(30) Foreign Application Priority Data

Oct. 30, 2014 (FI) ..... 20140141 U

(51) Int. Cl.

| | |
|---|---|
| ***B08B 9/04*** | (2006.01) |
| ***B08B 9/043*** | (2006.01) |
| ***B08B 9/045*** | (2006.01) |
| *E03F 9/00* | (2006.01) |

(52) U.S. Cl.
CPC ..... *B08B 9/0436* (2013.01); *B08B 9/045* (2013.01); *E03F 9/002* (2013.01)

(58) Field of Classification Search
CPC .. B08B 9/02; B08B 9/027; B08B 9/04; B08B 9/043; B08B 9/0436; B08B 9/045; F28G 3/06; F16G 13/18; E03F 9/002
USPC ..... 15/104.05, 104.31, 104.33; 59/84
See application file for complete search history.

(56) References Cited

U.S. PATENT DOCUMENTS

| | | | | |
|---|---|---|---|---|
| 5,293,916 A * | 3/1994 | Kucherry, Sr. | ..... | A01G 23/097 144/208.7 |
| 7,526,827 B1 * | 5/2009 | Bitterman | ..... | B08B 9/047 15/104.09 |
| 2005/0028306 A1 * | 2/2005 | Bergstrom | ..... | B08B 7/02 15/104.31 |

FOREIGN PATENT DOCUMENTS

| | | | | |
|---|---|---|---|---|
| GB | 684584 | * | 1/1951 | ..... B08B 9/02 |

* cited by examiner

*Primary Examiner* — Laura C Guidotti
(74) *Attorney, Agent, or Firm* — Harrington & Smith

(57) ABSTRACT

This invention relates to a cleaning device for the internal cleaning of drainpipes, which cleaning device includes one or more chains having several links. According to the invention on one or more sides of one or more links is fastened one or more hard metal blades.

6 Claims, 2 Drawing Sheets

CLEANING DEVICE

FIELD OF INVENTION

This invention relates to a cleaning device for the internal cleaning of drainpipes, which cleaning device includes one or more chains having several links.

BACKGROUND OF THE INVENTION

Recently, drainpipes are cleaned internally with cleaning devices by rotating a tool by means of a wire rope or an equivalent inside the drain. To the cleaning devices have been fastened pieces of a chain. Such a chain is formed by links connected together like known snow chains or lifting chains. The chains can also include claws bent from the chain known of snow chains. The purpose is to clean drainpipes internally from impurities, such as rust or tree roots. Often after cleaning, drainpipes are coated by known methods, by painting or by the so-called lining, in which method a liner-like product is pushed most commonly by compressed air inside the drainpipe and then hardened fast on the inner surface of the drain by known hardener, such as epoxy resin.

A problem of recent cleaning devices is that the cleaning chains are of similar material of their durability as the drainpipe itself. Because the iron drainpipe and the iron chain of the cleaning device are of the same toughness, cleaning power of the cleaning device is very weak and its operating life short. Due to the above reasons, the internal cleaning of drains is currently slow and expensive work.

The object of the invention is to introduce a cleaning device which is effective and durable, whereby the internal cleaning work of drains is quick and light work. A further purpose is that the same cleaning device can be used for cleaning drains of different inner diameters.

DESCRIPTION IF THE INVENTION

The invention is characterised by what is stated in the claims. Advantageous embodiments of the invention are the subject of the dependent claims.

The above disadvantaged can be eliminated and the above targets can be achieved by a cleaning device according to the invention.

The most important advantage of the invention is that, when hard metal pieces have been fastened to the chain of the cleaning device, they perform the cleaning work effectively and remain in cleaning order for a long time. The cleaning device includes one or more chains in which there are hard metal pieces/blades soldered or welded. Hard metal is very effective of its cleaning power e.g. in rust removal and has a long life. The cleaning device is also suitable for cleaning pipes before the pipe is coated by a liner or a liquid coating.

The chain of the cleaning device, which includes hard metal pieces or blades soldered or welded, is fastened to a body piece/fastening section which can be rotated inside the pipe, whereby the hard metal pieces in the chain will clean the inner surface of the pipe. The body/fastening section can be rotated e.g. by a wire rope mechanically, by a drilling machine, compressed air, or a hydraulic rotator. This can be done e.g. by a pneumatic or hydraulic motor or by pneumatic or hydraulic drilling machines. Hard metal is much harder of its hardness than steel and it is intended, inter alia, for machining and processing metals. Thus, it is much more suitable for cleaning pipes than blades/chains without hard metal blades/pieces. Time spent for the internal cleaning of drainpipes is substantially shortened when using such a cleaning device, whereby the cleaning is considerably quicker and more cost-effective. Hence, the use of the cleaning device provides economic savings in the repair of drains.

USE OF INVENTION

The cleaning device according to the invention is used for the effective internal cleaning of drainpipes to remove e.g. rust, tree roots and other impurities on the inner surface of the drainpipe. Furthermore, it can be used in pipe coating in addition to the internal cleaning of a drainpipe to open the liner and blockages in main lines and to remove e.g. rust, roots and other impurities on the inner surface of the pipe and in pipe coating in addition to the cleaning to open the liner and blockages in main lines.

The cleaning device is used such that the cleaning device is pushed inside a drain to be cleaned by means of a rotating shaft, after which, water is let to the drain and, simultaneously, the rotating shaft is switched on to rotate, whereby also the cleaning device rotates at the end of the rotating shaft. The rotating shaft is pulled at a suitable speed away from the drain simultaneously when the rotating shaft rotates, whereby water takes loose dirt away from inside the drain. As the cleaning device comes out of the drain, the inside of the drain will be cleaned. This treatment can be renewed after e.g. a known inspection done by a camera. The rotating shaft of the cleaning device is on a reel from which its length is easy to adjust. The reel includes a rotator of the rotating shaft, the rotation direction and rotation speed of which can be adjusted steplessly.

DESCRIPTION OF DRAWINGS

The invention will now be described in detail with reference to the accompanying figures.

The figures show cleaning devices which include the following parts and items: A chain 1 which includes a link 1*a*, the link 1*a* including sides 1*b* and ends 1*c*. The links 1*a* are connected to each other by fastening the ends 1*c* within each other, whereby the chain 1 is formed. The side 1*b* of the link 1*a* includes one or more fastening points 1*ba* for a blade 2. The blade 2 is fastened on one or both sides 1*b* of the link 1*a* of the chain 1 to the fastening point 1*ba* by soldering with silver, brass or some other known soldering material. One or more blades 2 can also be welded on one or more sides 1*b* of the link 1*a* of the chain 1 to the fastening point 1*ba* by a known welding method. The blade 2 is of hard metal which is commonly used in machining tools of cutters and lathes. The blade 2 includes an upper surface 2*a*, a lower surface 2*b*, a side surface 2*c*, and an end surface 2*d*. An inner angle 1*ac* of the upper surface 2*a* and the side surface 2*c* is 60-89 degrees. An inner angle 2*ad* of the upper surface 2*a* and the end surface 2*d* is 60-89 degrees. A fastening section 3 includes a fastener 3*a*, such as a friction screw, by which fastener is fastened non-rotatably a rotating element 5. Different from the figures, the fastener 3 can be used on the both ends of the cleaning device and, further different from the figures, the fastener can be e.g. a known U-shaped chain shackle. A sliding fastening section 4 moves freely in the longitudinal direction of the rotating element 5/rotating shaft, whereby the inner diameters of drains to be cleaned can vary significantly. The figures show the rotating element 5 which can be of a cross-woven wire rope or some other rotating element previously utilised in the use in question. As the rotating element for rotating the cleaning device, it is also possible to use known pneumatic motors, whereby a pneumatic hose operates as the rotating element. The figures also show a drainpipe 6 and a motion direction 7 of the sliding section when the cleaning device is switched on to rotate, and a motion direction 8 of the centrifugal force when the cleaning device is switched on to rotate. The figures also include a drawn rotation direction arrow 9 to illustrate the rotation direction; the rotation direction can also be rotating in the opposite direction. FIGS. 9 and 10 show a cleaning point 10 in which the blades 2 are against the inner surface of the drain.

Figure 1:
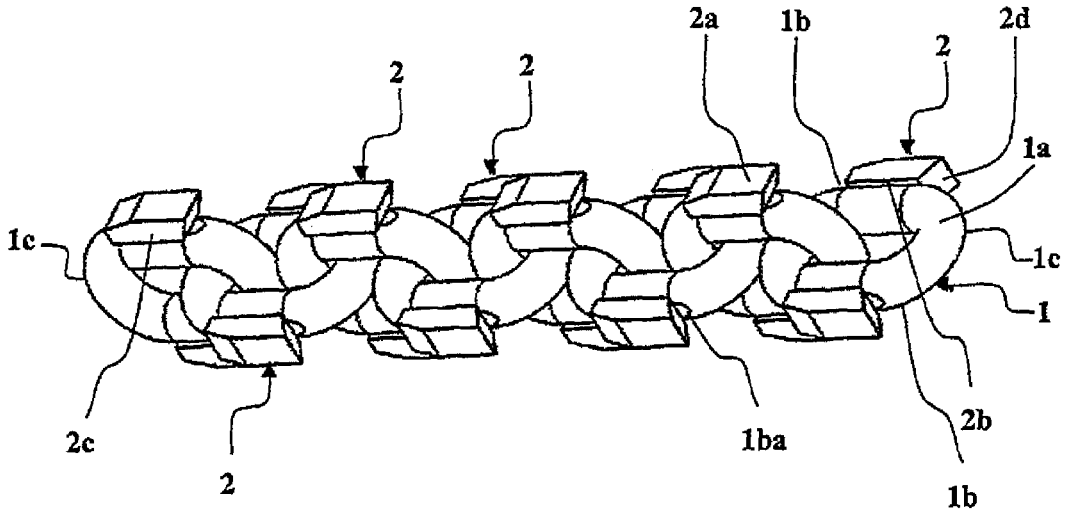
FIG. 1 shows an inclined side view of a chain of a cleaning device according to the invention, in which invented blades are fastened.
Figure 2:
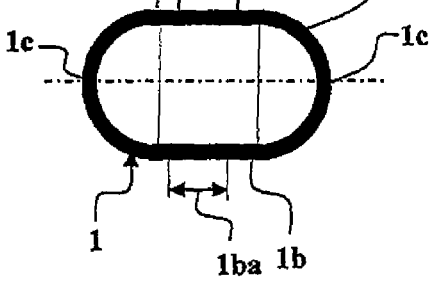
FIG. 2 schematically shows a perpendicular side view of a link of the chain according to FIG. 1, in which a flat area for a fastening point of the blade has been levelled.
Figure 3:
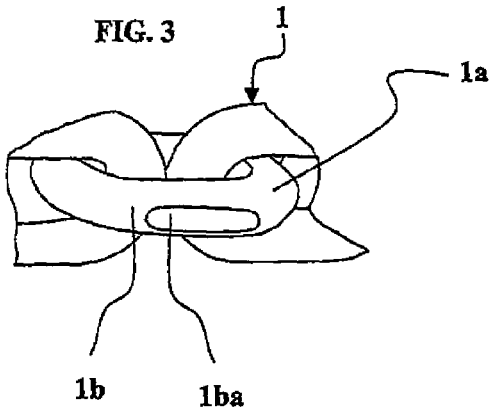
FIG. 3 shows an inclined side view of a side part of the chain according to FIGS. 1 and 2, in which a flat area for a fastening point of the blade has been levelled.

The figures show a cleaning device which is intended for use in the internal cleaning of drainpipes. It comprises one or more chains 1 which include several links 1*a*, one or more rotating elements 5 and one or more fastening sections 3 for fastening the chain 1 to the rotating element 5. On one or more sides 1*b* of the one or more links 1*a* is fastened one or more hard metal blades 2. The side 1*b* of the link 1*a* includes one or more fastening points 1*ba* for one or more blades 2. The fastening point 1*ba* can be levelled on the side 1*b* of the link 1*a*, thus providing a flat fastening surface for the blade 2.

The blade 2 shown in FIG. 1 is soldered or welded fast to the link 1*a*.

Figure 8:
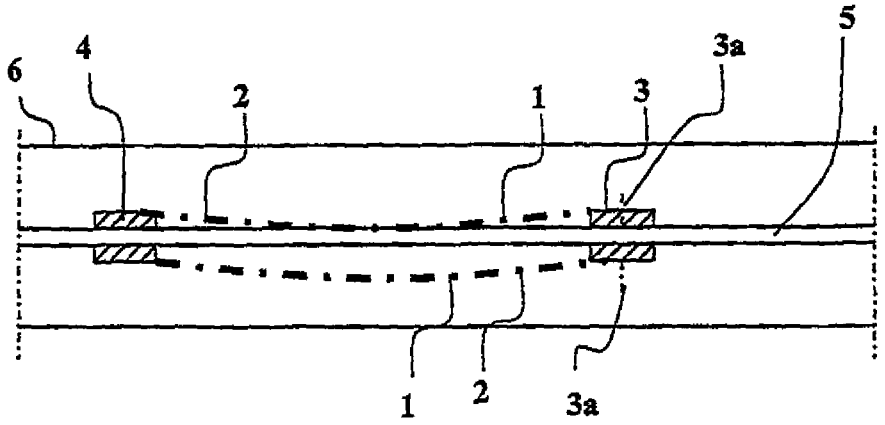
FIG. 8 schematically shows a cleaning device which is pushed inside a drain by a rotating shaft, the rotating shaft not rotating, and the figure is a perpendicular side view cut in the longitudinal direction of the drain.
Figure 9:
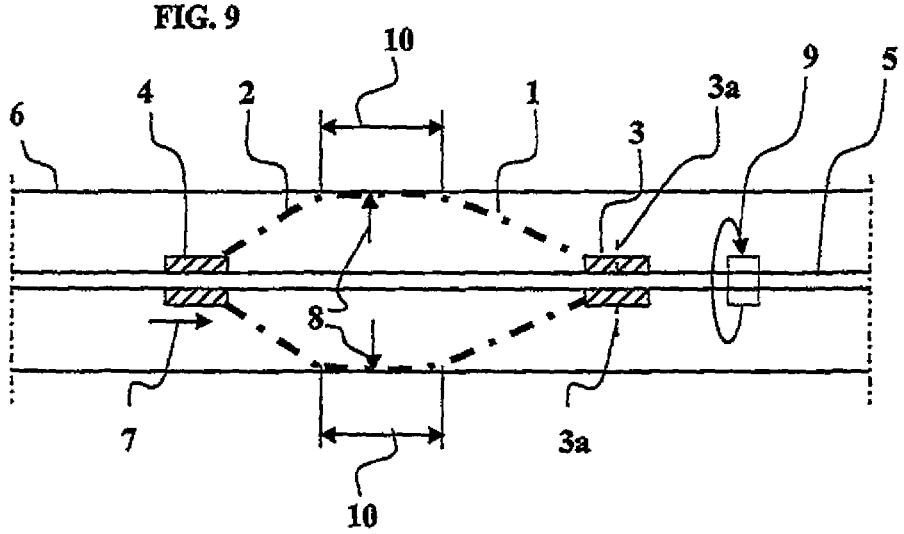
FIG. 9 shows the cleaning device according to FIG. 8 which is pushed inside a drain by a rotating shaft, the rotating shaft rotating and the blades of the chains of the cleaning device cleaning the inner surface of the drain, and the figure is a perpendicular side view cut in the longitudinal direction of the drain.
Figure 10:
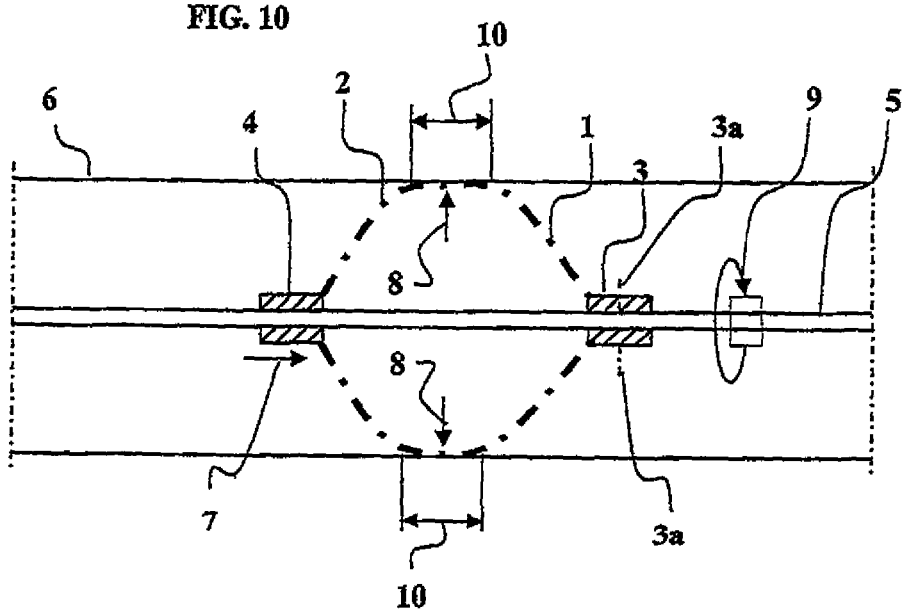
FIG. 10 shows the cleaning device according to FIGS. 8 and 9 cleaning a drain being larger of its inner diameter, which cleaning device is pushed inside the drain by a rotating shaft, the rotating shaft rotating and the blades of the chains of the cleaning device cleaning the inner surface of the drain, and the figure is a perpendicular side view cut in the longitudinal direction of the drain.

The fastening section 3 shown in FIGS. 8, 9 and 10 consists of a circular hollow sleeve to which one or more chains 1 are welded fast of the link 1*a* at the end of the chain 1, and the fastening section 3 includes one or more fasteners 3*a*, being a friction screw, by means of the friction of which the fastener 3 stays in its place non-rotatably in the rotating element 5.

Different from the figures, the fastening section 3 can consists of a U-shaped chain shackle fastenable by screws, by which the chain 1 is fastened of the link 1*a* at its end to the rotating element 5.

Different from the figures, several cleaning devices can be fastened one after the other to one rotating element 5. Furthermore, the blades 2 of successive cleaning devices can differ from each other by their shape and size.

The figures show that the blade 2 includes the upper surface 2*a*, the lower surface 2*b*, the side surface 2*c*, and the end surface 2*d*, and that the blade 2 is soldered or welded fast to the link 1*a* of its lower surface 2*b*.

Figure 4:
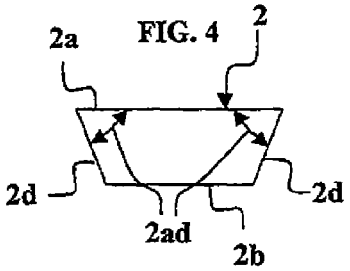
FIG. 4 shows a perpendicular side view of an invented blade.
Figure 5:
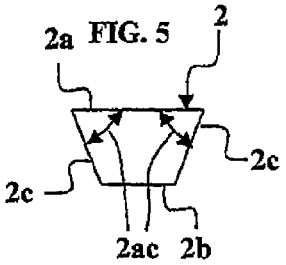
FIG. 5 shows a perpendicular end view of the blade according to FIG. 4.
Figure 6:
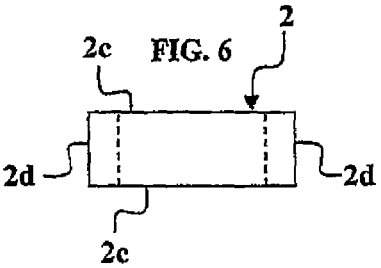
FIG. 6 shows a perpendicular side view of the blade according to FIGS. 4 and 5.
Figure 7:
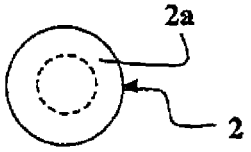
FIG. 7 shows a blade which is circular when seen of its perpendicular top view and according to FIG. 5 when seen of its side view.

FIGS. 4 and 5 show that the inner angle 2*ac* of the upper surface 2*a* and the side surface 2*c* is 60-89 degrees. The inner angle tad of the upper surface 2*a* and the end surface 2*d* is 60-89 degrees. The above construction makes the blade 2 shaving/cutting of its upper surface 2*a*. The blade 2 is of the shape of a rectangle or a square when seen from the upper surface 2*a*. According to another inventive construction, when seen from the upper surface 2*a*, the blade 2 is of the shape of a circle or an ellipse or a rectangle having semicircular ends. In this other solution, no sharp angles are formed on the upper surface 2*a* of the blade 2, which could scratch pipes being in poor condition.

The parts of the cleaning device are manufactured by known methods of known materials and most advantageously of metal.

It is obvious for those skilled in the art the above embodiment examples are relatively simple of their construction and operation for the sake of the description being illustrative. Using the model described here, it is possible to manufacture very different constructions which utilise the inventive idea depicted. The invention is not limited solely to the alternatives described above, but many modifications are possible within the scope of the inventive idea defined by the enclosed claims.

The invention claimed is:

1. A cleaning device for the internal cleaning of drainpipes, including one or more chains including several links, and on one or more sides of one or more links is fastened to one or more hard metal blades, each one of the one or more blades includes an upper surface, a lower surface, a side surface and an end surface, and each one of the one or more blades is soldered or welded fast to the link of its lower surface, and an inner angle of the upper surface and the side surface is 60 to 89 degrees, wherein, a fastening section comprises a circular hollow sleeve to which one or more chains are welded fast to the link at the end of the chain, and the fastening section includes one or more fasteners, at least one of the one or more fasteners being a friction screw.

2. A cleaning device according to claim 1, wherein the side of the one or more links includes one or more fastening points for one or more blades.

3. A cleaning device according to claim 1, wherein the one or more blades is soldered or welded fast to the link.

4. A cleaning device according to claim 1, wherein an inner angle of the upper surface and the end surface is 60-89 degrees.

5. A cleaning device according to claim 1, wherein when seen from the upper surface, each one of the one or more blades is of the shape of a circle or an ellipse or a rectangle having semicircular ends.

6. A cleaning device according to claim 1, wherein a fastening section comprises a U-shaped chain shackle fastenable by screws, by which the chain is fastenable of the link at its end to a rotating element.

* * * * *